US008371844B2

(12) United States Patent
Querejeta Andueza et al.

(10) Patent No.: US 8,371,844 B2
(45) **Date of Patent: *Feb. 12, 2013**

(54) CONTROL SYSTEM FOR THE IGNITION OF A GAS BURNER

(75) Inventors: Félix Querejeta Andueza, Vitoria-Gasteiz (ES); Gonzalo José Fernández Llona, Elorrio (ES); José Ignacio Múgica Odriozola, Bergara (ES); Francisco Javier Echenausia Saez de Zaitegui, Aretxabaleta (ES)

(73) Assignee: Coprecitec, S.L., Aretxabaleta (ES)

( * ) Notice: Subject to any disclaimer, the term of this patent is extended or adjusted under 35 U.S.C. 154(b) by 1057 days.

This patent is subject to a terminal disclaimer.

(21) Appl. No.: 12/343,283

(22) Filed: Dec. 23, 2008

(65) Prior Publication Data

US 2010/0086885 A1 Apr. 8, 2010

(30) Foreign Application Priority Data

Oct. 2, 2008 (ES) ..... 200802834

(51) Int. Cl.
*F23Q 7/10* (2006.01)
*F23N 5/00* (2006.01)

(52) U.S. Cl. ..... 431/66; 431/12; 431/6; 431/72; 431/75; 137/66; 251/129.09; 335/180; 361/160; 361/191; 361/166

(58) Field of Classification Search ..... 431/66, 431/78, 26, 46, 54; 137/66; 361/160, 191, 361/166; 335/180; 251/129.09
See application file for complete search history.

(56) References Cited

U.S. PATENT DOCUMENTS

| | | | | |
|---|---|---|---|---|
| 2,379,113 | A * | 6/1945 | Strobel | 431/67 |
| 3,144,898 | A * | 8/1964 | Queever | 431/68 |
| 3,597,139 | A * | 8/1971 | Elders | 431/66 |
| 3,826,605 | A | 7/1974 | Hantack | |
| 3,862,820 | A | 1/1975 | Hantack | |
| 4,002,419 | A * | 1/1977 | Hantack et al. | 431/67 |
| 4,360,338 | A * | 11/1982 | Katchka | 431/46 |
| 5,133,656 | A * | 7/1992 | Peterson | 431/66 |
| 6,222,719 | B1 * | 4/2001 | Kadah | 361/247 |
| 6,322,352 | B1 * | 11/2001 | Zink | 431/27 |
| 6,324,046 | B1 * | 11/2001 | Kadah | 361/166 |
| 7,634,476 | B2 * | 12/2009 | Liu et al. | 1/1 |
| 2010/0255433 | A1 * | 10/2010 | Querejeta Andueza et al. | 431/12 |

FOREIGN PATENT DOCUMENTS

WO WO9837367 A1 8/1998

OTHER PUBLICATIONS

STIC Search report—NPL.*

* cited by examiner

*Primary Examiner* — Steven B McAllister
*Assistant Examiner* — Nikhil Mashruwala
(74) *Attorney, Agent, or Firm* — Tim L. Kitchen; Peter B. Scull; Hamilton, DeSanctis & Cha, LLP

(57) ABSTRACT

A control system for the ignition of a gas burner that includes an electromagnetic valve having a first coil and a second coil, the activation of the first and second coils controlling the flow of gas through the electromagnetic valve. An incandescent element which is designed to be heated until it reaches the gas combustion temperature of the gas delivered to the burner is disposed electrically in series with the first coil, the incandescent element and first coil forming a first branch that is electrically parallel to the second coil.

38 Claims, 2 Drawing Sheets

CONTROL SYSTEM FOR THE IGNITION OF A GAS BURNER

CROSS-REFERENCE TO RELATED APPLICATIONS

This application claims priority to Spanish Patent Application No. P200802834, filed Oct. 2, 2008.

TECHNICAL FIELD

The present invention relates to control systems for the ignition of a gas burner, and more specifically to a burner used in domestic gas appliances such as cookers and driers, which comprise an incandescent element for causing the ignition.

BACKGROUND

Different control systems for the ignition of a burner in domestic gas appliances are already known. In some of the systems an incandescent element or an igniter (a glowbar) is used for such a purpose. The incandescent element is disposed adjacent to the burner and is heated up to a temperature suitable for gas combustion, the incandescent element causing, when it reaches the temperature, the gas that reaches the burner to light.

U.S. Pat. No. 3,826,605 discloses a control system of this type, the control system comprising a thermoelectric valve to enable the passage of gas towards the burner. The thermoelectric valve comprises a bimetallic element and a resistive element that keeps the passage of gas closed at ambient temperature, this being opened when the bimetallic element is heated by the power supply current of the igniter. The choice of material of the elements and their arrangement is essential in ensuring the system functions correctly and that the valve does not open too early, for example, or open too late after the incandescent element has reached the combustion temperature. In addition, as it is dependent upon the temperature of the elements in order to close, the thermoelectric valve may remain open for a period of time after the command to switch off the burner has been sent, with gas reaching the burner during the period of time. In a second embodiment disclosed in the document, the control system also comprises an electromagnetic valve, it being necessary for both the thermoelectric and the electromagnetic valve to be open to enable the passage of gas. The thermoelectric valve continues to control the opening of the passage of gas, whereas the electromagnetic valve controls the closure of the passage.

SUMMARY OF THE DISCLOSURE

It is an object of the invention to provide a control system for the ignition of a gas burner, as described herein and as set forth in the claims.

The control system for the ignition of a gas burner in one implementation comprises at least one incandescent element that is designed to be heated until it reaches the gas combustion temperature and which is disposed adjacent to a burner in order to light the gas that reaches the burner, a power source for powering the incandescent element and thereby cause it to heat up, an electromagnetic valve to allow the passage of gas towards the burner, and an activation coil associated to the electromagnetic valve in order to open the valve.

The control system also comprises an additional coil associated to the electromagnetic valve and disposed electrically in series with the incandescent element, the additional coil and the incandescent element forming a branch electrically parallel to the activation coil, the valve being closed when power no longer reaches the additional coil.

When the incandescent element reaches the gas combustion temperature and both coils are powered; the electromagnetic valve opens to allow the passage of gas to the burner. The burner may be switched off by preventing power from being supplied to the coils, and, as the electromagnetic valve is not dependent upon the temperature as it would be if it were a thermoelectric valve, the valve thus is closed preventing the passage of gas towards the burner.

As a result, the use of a thermoelectric valve is not necessary in order to control the point at which the passage of gas towards the burner is opened, the control being performed through the electromagnetic valve that also controls the point at which the passage is prevented. Thus, the control system requires fewer elements and may also be more compact.

These and other advantages and characteristics of the invention will be made evident in the light of the drawings and the detailed description thereof.

DETAILED DESCRIPTION

Figure 1:
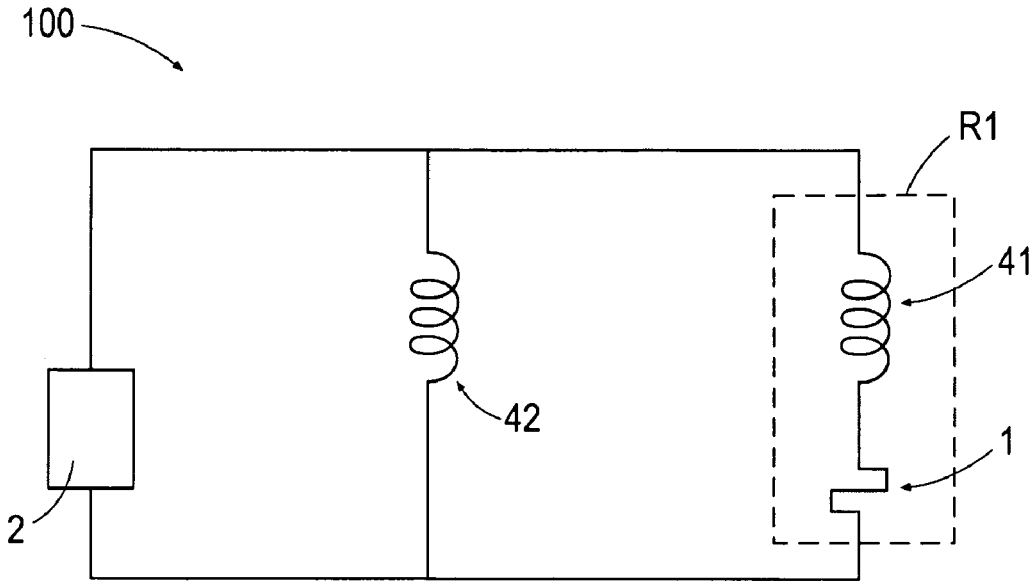
FIG. 1 schematically shows a first embodiment of a control system of the invention.
Figure 2:
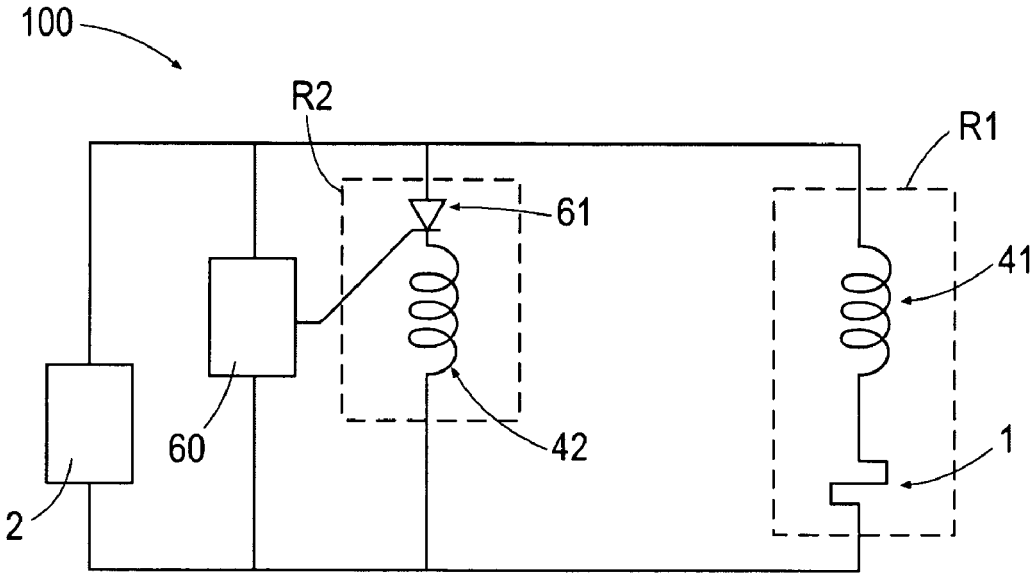
FIG. 2 schematically shows a second embodiment of a control system of the invention.
Figure 3:
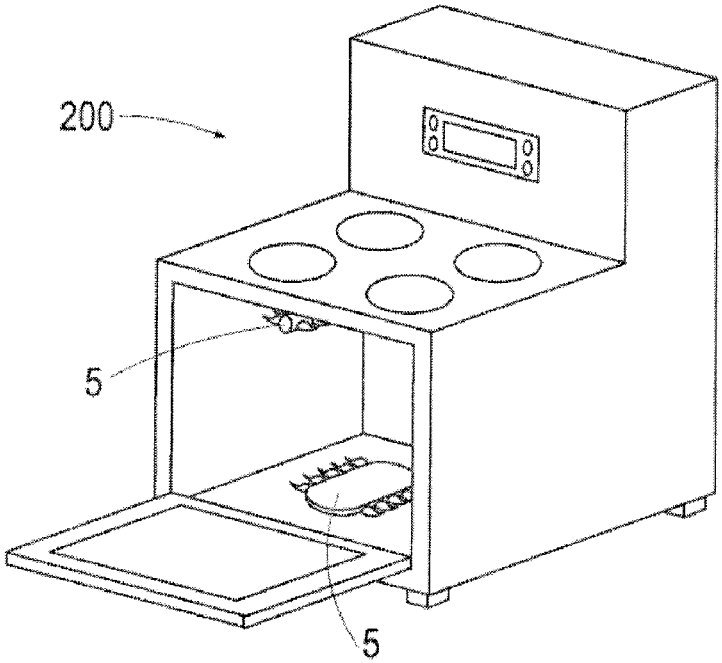
FIG. 3 is a perspective view of a domestic gas appliance where a control system of FIG. 1 or a control system of FIG. 2 may be used.
Figure 4:
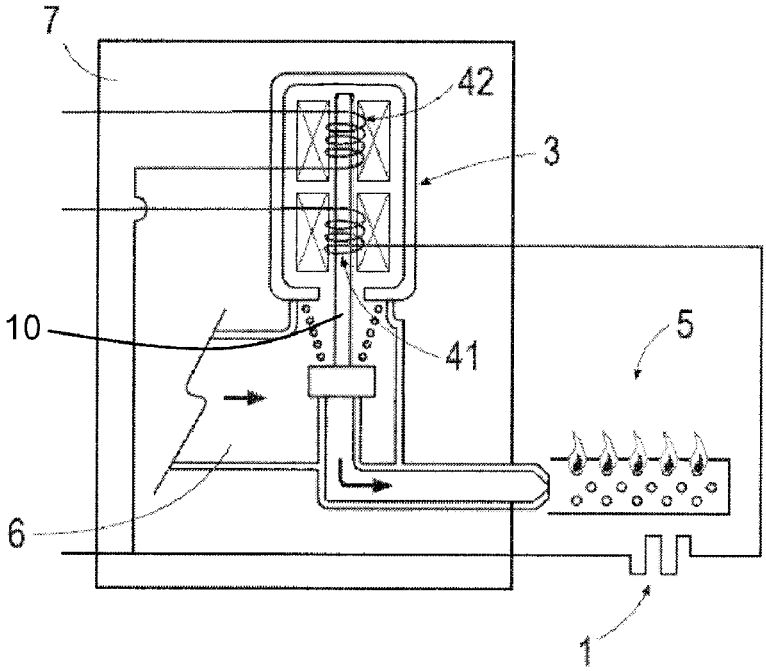
FIG. 4 shows a configuration of a control module of the domestic gas appliance of FIG. 3.

FIGS. 1 and 2 in combination with FIGS. 3 and 4 show embodiments of the control system 100 for the ignition of a gas burner according to different implementations, which preferably comprise at least one incandescent element or glow bar 1, which is designed to be heated until it reaches the gas combustion temperature and which is disposed adjacent to a gas burner 5, a power source 2 for powering the incandescent element 1 and thereby cause it to heat up, and an electromagnetic valve 3 for allowing or preventing the passage of gas to the burner 5, the incandescent element 1 causing the combustion of the gas when gas passes through the electromagnetic valve 3 and when the incandescent element 1 has reached the gas combustion temperature. The gas reaches the burner 5 from a fuel source (not shown in the Figures) through a fuel pipe 6, and the valve 3 allows the passage of gas through the pipe 6 from the fuel source to the burner 5 when it is open, or prevents the passage when it is closed.

The control system 100 is designed for domestic gas appliances 200, such as a cooker as shown in FIG. 3 or a drier (not shown in the Figures). The appliances 200 may comprise a single burner or a plurality of burners 5, the control system 100 preferably comprising an incandescent element 1 and a valve 3 for each burner 5, the valve 3 being designed to allow or prevent the passage of gas to the corresponding burner 5, and the power source 2 being adapted in order to power and heat the incandescent elements 1. The appliances 200 may also comprise, generally, a control circuit board (not shown in the Figures) by means of which the power of the burners 5 is controlled, for example, and through which the appliances 200 are powered. Thus, the power source 2 of the control system 100 is preferably disposed on the control circuit board.

In one embodiment, the electromagnetic valve comprises a rod 10 upon which at least two coils 41 and 42 are wound. When the coils are activated or powered with sufficient current, the rod 10 is moved, thereby opening the valve at the same time. Thus, in one embodiment, the control system 100 comprises activation coils 41 and 42 associated to the valve 3 in order to open the valve 3, the opening enabling the valve 3 to allow the passage of gas to the burner 5. As shown in the Figures, coil 41 is disposed electrically in series with the incandescent element 1, the coil 41 and the incandescent element 1 forming a branch RI electrically parallel to the activation coil 42. As a result, if the incandescent element 1 breaks down, the current stops circulating through the coil 41 due to the fact that it is disposed on the same branch as the incandescent element 1, and the valve 3 closes preventing the passage of gas to the burner 5.

In the embodiment of FIG. 1, the valve 3 is designed to open once the incandescent element 1 has reached the gas combustion temperature, the gas that reaches the burner 5 thus being lit, with the result that in order to open, it also depends on the current that passes through the coil 41, this being dependent on the temperature of the incandescent element 1. Thus, it is necessary that the current increases along with the temperature of the incandescent element 1. For example, in one embodiment the incandescent element 1 displays NTC (negative temperature coefficient) behaviour, in which the resistance of the incandescent element 1 reduces as its temperature increases, thus increasing the current that passes through the incandescent element 1 and, therefore, through coil 41.

The burner 5 may be switched off by turning off the power supply, thereby preventing power from being supplied to the coils 41 and 42, the valve 3 thus closing straightaway, preventing the passage of gas to the burner 5.

In the embodiment, the control system 100 may also operate without the activation coil 42, although the additional coil 41 would have to be adapted in order to allow it to open the valve 3 by itself, which would involve a much larger size of coil, preventing the obtaining of a compact control system 100 as is the case with the activation coil 42.

In a preferred embodiment shown in FIG. 2, the valve 3 is designed so that the additional coil 41 may keep the valve 3 open by itself but may not open it by itself. In order to light the burner 5, in a first moment power is supplied to the additional coil 41 and the incandescent element 1, but not the activation coil 42, it being necessary to power it afterwards in order to open the valve 3 and allow the passage of gas to the burner 5. In this case, the opening of the valve 3 depends, lastly, upon the activation coil 42, the use of a specific type of incandescent element 1 not being necessary, an incandescent element with NTC (negative temperature coefficient) or PTC (positive temperature coefficient) behaviour, or another type of behaviour, being capable of being used. For this purpose, the control system 100 comprises an activator to power the activation coil 42, powering it once the incandescent element 1 has reached the gas combustion temperature.

The activator preferably comprises a switch 61 disposed electrically in series with the activation coil 42, forming, along with the activation coil 42, a second branch R2 parallel to the branch R1 formed by the additional coil 41 and the incandescent element 1. In one embodiment, the switch 61 is normally open, preventing the activation coil 42 from being powered, and closing when the burner 5 is to be lit and the incandescent element 1 has reached the gas combustion temperature. The switch 61 preferably comprises a thyristor as shown in FIG. 2.

The activator may also comprise a control device 60 that acts on the switch 61 when a predetermined time equal to or greater than the time necessary for the incandescent element 1 to reach the gas combustion temperature has elapsed, the switch 61 allowing the activation coil 42 to be powered. This guarantees that the valve 3 opens when the incandescent element 1 has reached the gas combustion temperature.

The control device 60 acts on the switch 61, preferably by means of an activation pulse, the switch 61 allowing the activation coil 42 to be powered only during the activation pulse, given that the additional coil 41 may keep the valve open by itself. In addition, if the incandescent element 1 breaks down, for example, the additional coil 41 is no longer powered and as power is prevented from reaching the activation coil 42, the valve 3 does not allow the passage of gas to the burner 5. The control device 60 may also generate, for example, at least one additional pulse for the purposes of safety to ensure that the valve 3 has opened.

Instead of a control device 60 and a thyristor, the activator may comprise, for example, a temperature sensor (not shown in the Figures) that activates the switch 61 when it detects that the incandescent element 1 has reached the gas combustion temperature, thus allowing power to be supplied to the activation coil 42, permitting valve 3 to be opened.

In a preferred embodiment, in order to switch the burner 5 off, the power supply is switched off, thereby preventing power from being supplied to the coil 41, the valve 3 thus closing straightaway, preventing the passage of gas to the burner 5.

The control system 100 may be comprised in the domestic gas appliance 200 in a variety of different arrangements. In a first preferred arrangement shown in FIG. 4, a control module 7 comprises the electromagnetic valve 3 and the coils 41 and 42, the control module 7 comprising two power inputs through which the power supply reaches the additional coil 41 from the power source 2 which may be disposed on the control plate of the appliance 200, and an additional input for carrying the power supply to the activation coil 42, by means of the activator disposed, preferably, on the control circuit board of the appliance 200.

In a second preferred arrangement not shown in the Figures, the appliance 200 may comprise a control module 7 that comprises the valve 3, the coils 41 and 42 and the activator. The control module 7 may comprise two power inputs through which the power supply reaches the coils 41 and 42 and the activator from the power source 2 which may be disposed on the control plate of the appliance 200.

In a third preferred arrangement not shown in the figures, the control module 7 comprises only the coils 41 and 42 and the switch 60 of the activator, the control module 7 comprising two or three power inputs through which the power supply reaches the coils 41 and 42 and the switch means from the power source 2 which may be disposed on the control plate of the appliance 200, and an additional input for carrying the activation pulse or the signal generated by the control means 60 to the switch means.

What is claimed is:

1. A control system for the ignition of a gas burner comprising:

an electromagnetic valve having an open position and a closed position for controlling the flow of a gas to the burner, the electromagnetic valve having a first coil and a second coil, the electromagnetic valve configured to assume the open position to permit the flow of gas through the electromagnetic valve to the burner when a current that passes through the first coil reaches a first predetermined amount and when a current that passes through the second coil reaches a second predetermined amount, the first coil configured to hold the electromagnetic valve in the open position by itself after the electromagnetic valve has assumed the open position; and at least one incandescent element for igniting the gas burner when the incandescent element reaches a combustion temperature of the gas, the incandescent element being disposed electrically in series with the first coil, the first coil and incandescent element forming a first branch that is electrically parallel to the second coil.

2. A control system according to claim 1, wherein the initial amount of current delivered through the first coil is at least partially dependent on the temperature of the incandescent element.

3. A control system according to claim 2, wherein the at least the first predetermined amount of current is delivered through the first coil to permit the electromagnetic valve to assume the open position only upon the incandescent element reaching the gas combustion temperature.

4. A control system according to claim 3, wherein the incandescent element exhibits NTC behavior.

5. A control system according to claim 1, wherein the system is configured to deliver the second predetermined amount of current through the second coil only upon the incandescent element reaching the gas combustion temperature.

6. A control system according to claim 3, wherein the system is configured to deliver the second predetermined amount of current through the second coil only upon the incandescent element reaching the gas combustion temperature.

7. A control system according to claim 1, further comprising a switch disposed electrically in series with the second coil, the switch and second coil forming a second branch that is electrically parallel to the first branch, the switch configured to control the flow of current through the second coil.

8. A control system according to claim 7 wherein the switch is normally open, the control system further comprising a control device that is configured to act upon the switch after a predetermined amount of time after power is supplied to the incandescent element to cause the switch to close to permit the second predetermined amount of current to pass through the second coil.

9. A control system according to claim 7, wherein the switch is normally open, the control system further comprising a control device that is configured to act upon the switch to cause the switch to close to permit the second predetermined amount of current to pass through the second coil when or after the incandescent element reaches the gas combustion temperature.

10. A control system according to claim 7, wherein the switch is normally open, the control system further comprising a temperature sensor that is configured to act upon the switch to cause the switch to close to permit the second predetermined amount of current to pass through the second coil when or after the incandescent element reaches the gas combustion temperature.

11. A control system according to claim 7, wherein the switch comprises a thyristor.

12. A control system according to claim 8, wherein the control device is configured to deliver an activation pulse to the switch when the predetermined time has elapsed to temporarily close the switch, the first coil being configured to hold the electromagnetic valve in the open position by itself after the electromagnetic valve has assumed the open position.

13. A control system according to claim 9, wherein the control device is configured to deliver an activation pulse to the switch when the incandescent element reaches the gas combustion temperature to temporarily close the switch, the first coil being configured to hold the electromagnetic valve in the open position by itself after the electromagnetic valve has assumed the open position.

14. A control system according to claim 1 further comprising a power supply disposed electrically in parallel to the first coil and to the second coil.

15. A method for controlling the gas flow to a burner through an electromagnetic valve having a normally closed position and an open position, the electromagnetic valve having a first coil and a second coil that control the position of the electromagnetic valve, the first coil is configured to hold the electromagnetic valve in the open position by itself once the electromagnetic valve assumes the open position, the first coil being disposed electrically in series with an incandescent element that is positioned to ignite the burner when the temperature of the incandescent element reaches a combustion temperature of the gas delivered to the burner, the first coil and incandescent element forming a first branch that is electrically parallel to the second coil, the method comprising:

delivering a first current through the first branch comprising the first coil and the incandescent element in series to provide power to the first coil and to cause the incandescent element to heat;

subsequently delivering a second current to the second coil electrically parallel to the first branch to cause the electromagnetic valve to open; and terminating the flow of the second current to the second coil once the electromagnetic valve has assumed the open position.

16. A method according to claim 15, wherein the second current is delivered to the second coil only upon the incandescent element has reaching the gas combustion temperature.

17. A method according to claim 15, wherein the second current is delivered to the second coil after a predetermined amount of time after power is supplied to the incandescent element.

18. A method according to claim 17 wherein the predetermined amount of time is equal to or greater than the time necessary for the incandescent element to reach the gas combustion temperature.

19. A method according to claim 15, wherein the resistance of the incandescent element reduces as its temperature increases to cause an increase in the amount of current that passes the incandescent element and the first coil.

20. A control system for the ignition of a gas burner comprising:

an electromagnetic valve having an open position and a closed position for controlling the flow of a gas to the burner, the electromagnetic valve having a first coil and a second coil, the electromagnetic valve configured to assume the open position to permit the flow of gas through the electromagnetic valve to the burner when a current that passes through the first coil reaches a first predetermined amount and when a current that passes through the second coil reaches a second predetermined amount;

at least one incandescent element for igniting the gas burner when the incandescent element reaches a combustion temperature of the gas, the incandescent element being disposed electrically in series with the first coil, the first coil and incandescent element forming a first branch that is electrically parallel to the second coil; and a switch disposed electrically in series with the second coil, the switch and second coil forming a second branch that is electrically parallel to the first branch, the switch configured to control the flow of current through the second coil.

21. A control system according to claim 20, wherein the initial amount of current delivered through the first coil is at least partially dependent on the temperature of the incandescent element.

22. A control system according to claim 21, wherein the at least the first predetermined amount of current is delivered through the first coil to permit the electromagnetic valve to assume the open position only upon the incandescent element reaching the gas combustion temperature.

23. A control system according to claim 22, wherein the incandescent element exhibits NTC behavior.

24. A control system according to claim 20, wherein the system is configured to deliver the second predetermined amount of current through the second coil only upon the incandescent element reaching the gas combustion temperature.

25. A control system according to claim 22, wherein the system is configured to deliver the second predetermined amount of current through the second coil only upon the incandescent element reaching the gas combustion temperature.

26. A control system according to claim 20, wherein the first coil is configured to hold the electromagnetic valve in the open position by itself after the electromagnetic valve has assumed the open position.

27. A control system according to claim 20 wherein the switch is normally open, the control system further comprising a control device that is configured to act upon the switch after a predetermined amount of time after power is supplied to the incandescent element to cause the switch to close to permit the second predetermined amount of current to pass through the second coil.

28. A control system according to claim 20, wherein the switch is normally open, the control system further comprising a control device that is configured to act upon the switch to cause the switch to close to permit the second predetermined amount of current to pass through the second coil when or after the incandescent element reaches the gas combustion temperature.

29. A control system according to claim 20, wherein the switch is normally open, the control system further comprising a temperature sensor that is configured to act upon the switch to cause the switch to close to permit the second predetermined amount of current to pass through the second coil when or after the incandescent element reaches the gas combustion temperature.

30. A control system according to claim 20, wherein the switch comprises a thyristor.

31. A control system according to claim 27, wherein the control device is configured to deliver an activation pulse to the switch when the predetermined time has elapsed to temporarily close the switch, the first coil being configured to hold the electromagnetic valve in the open position by itself after the electromagnetic valve has assumed the open position.

32. A control system according to claim 28, wherein the control device is configured to deliver an activation pulse to the switch when the incandescent element reaches the gas combustion temperature to temporarily close the switch, the first coil being configured to hold the electromagnetic valve in the open position by itself after the electromagnetic valve has assumed the open position.

33. A control system according to claim 20 further comprising a power supply disposed electrically in parallel to the first coil and to the second coil.

34. A method for controlling the gas flow to a burner through an electromagnetic valve having a normally closed position and an open position, the electromagnetic valve having a first coil and a second coil that control the position of the electromagnetic valve, the first coil is configured to hold the electromagnetic valve in the open position by itself once the electromagnetic valve assumes the open position, the first coil being disposed electrically in series with an incandescent element that is positioned to ignite the burner when the temperature of the incandescent element reaches a combustion temperature of the gas delivered to the burner, the first coil and incandescent element forming a first branch that is electrically parallel to the second coil, the method comprising:

delivering a first current through the first branch comprising the first coil and the incandescent element in series to provide power to the first coil and to cause the incandescent element to heat; and subsequently delivering a second current to the second coil electrically parallel to the first branch to cause the electromagnetic valve to open, the second current being delivered to the second coil only for an amount of time sufficient to open the electromagnetic valve;

subsequently holding the electromagnetic valve open with the first coil only.

35. A method according to claim 34, wherein the second current is delivered to the second coil only upon the incandescent element has reaching the gas combustion temperature.

36. A method according to claim 34, wherein the second current is delivered to the second coil after a predetermined amount of time after power is supplied to the incandescent element.

37. A method according to claim 36 wherein the predetermined amount of time is equal to or greater than the time necessary for the incandescent element to reach the gas combustion temperature.

38. A method according to claim 34, wherein the resistance of the incandescent element reduces as its temperature increases to cause an increase in the amount of current that passes the incandescent element and the first coil.

* * * * *